US005699975A

United States Patent [19]

Paugh et al.

[11] Patent Number: 5,699,975

[45] Date of Patent: Dec. 23, 1997

[54] EXTENSION MEMBER ANCHOR

[75] Inventors: Edward C. Paugh, Huntington Beach; Harley W. Leafstone, Ontario; Nicholas P. Hortick, Pomona, all of Calif.

[73] Assignee: West Coast Chain Mfg. Company, Ontario, Calif.

[21] Appl. No.: 615,963

[22] Filed: Mar. 14, 1996

[51] Int. Cl.[6] ..... B65H 75/48; A44B 1/04; B65G 3/28

[52] U.S. Cl. ..... 242/371; 242/376; 242/125.1; 242/532.5; 242/586.3; 24/136 K; 403/282

[58] Field of Search ..... 242/376, 371, 242/532.5, 586.3, 345, 348.1, 125.1, 407; 403/282, 291; 24/703.1, 136 R, 136 K

[56] References Cited

U.S. PATENT DOCUMENTS

| | | | |
|---|---|---|---|
| 182,071 | 9/1876 | Hill | 242/371 |
| 331,956 | 12/1885 | Ford | 242/371 |
| 1,485,663 | 3/1924 | Best | 242/371 |
| 1,567,783 | 12/1925 | Best | 242/371 |
| 1,802,402 | 4/1931 | Best | 242/371 |
| 1,851,326 | 3/1932 | Radford | 242/74.1 |
| 2,571,341 | 5/1951 | Cordrey et al. | 242/117 |
| 2,615,651 | 10/1952 | Johnson | 242/125 |
| 2,811,322 | 12/1957 | Wilkinson | 242/117 |
| 3,191,308 | 6/1965 | Lindenau | 33/87 |
| 3,220,665 | 11/1965 | Modrey | 242/74.1 |
| 3,463,411 | 8/1969 | Brown | 242/74.1 |
| 3,465,980 | 9/1969 | Edwards et al. | 242/74.1 |
| 3,491,965 | 1/1970 | Crapsey | 242/74.1 |
| 3,719,332 | 3/1973 | McLain | 242/125.1 |
| 3,802,638 | 4/1974 | Dragan | 242/74 |
| 3,825,227 | 7/1974 | Whitehill et al. | 254/161 |
| 3,848,265 | 11/1974 | Biery et al. | 360/132 |
| 3,863,851 | 2/1975 | Sartori | 242/18 |
| 3,889,894 | 6/1975 | Deguchi | 242/74 |
| 3,982,844 | 9/1976 | De Anda et al. | 403/211 |
| 3,990,733 | 11/1976 | Shiba et al. | 242/74 |
| 4,018,398 | 4/1977 | Louzil | 242/74.1 |
| 4,213,578 | 7/1980 | Katata | 242/74 |
| 4,422,316 | 12/1983 | Thomas et al. | 70/456 R |
| 4,473,102 | 9/1984 | Ohman et al. | 24/136 K X |
| 4,502,226 | 3/1985 | Hung | 33/138 |
| 4,715,549 | 12/1987 | Travlos | 242/25 R |
| 5,042,159 | 8/1991 | Millen | 33/414 |

*Primary Examiner*—John Q. Nguyen
*Attorney, Agent, or Firm*—Pretty, Schroeder & Poplawski

[57] ABSTRACT

A spring drive retractor having a case with an inner space for a spring and a reel, with one end of the spring connected to the case and the other end of the spring connected to the reel, with an extension member having one end connected to the reel and the other end passing outward through the case, with the reel comprising a body and a post molded as a single piece with the post projecting laterally from the body in line with a transverse opening in the body and with the post and body joined by a rupturable membrane, the post having an extension member receiving opening whereby an extension member may be connected to the reel by driving the post into the body opening.

3 Claims, 2 Drawing Sheets

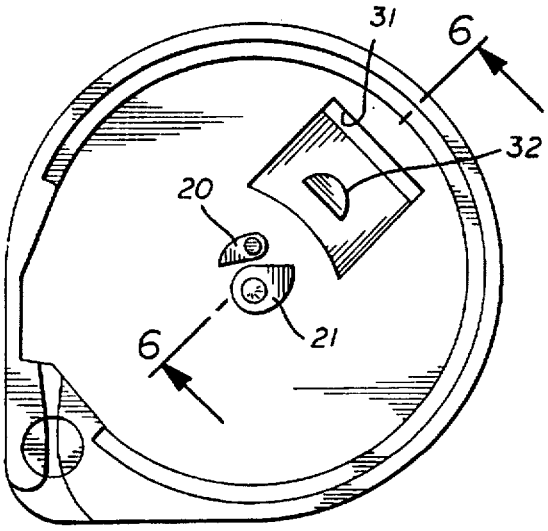
FIG. 5
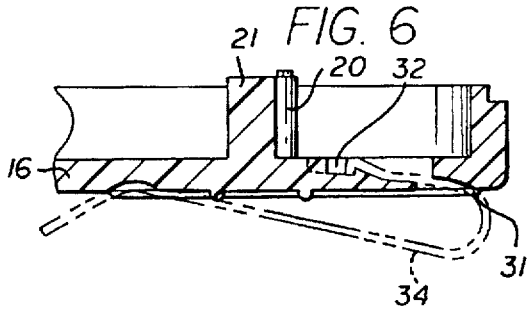
FIG. 6
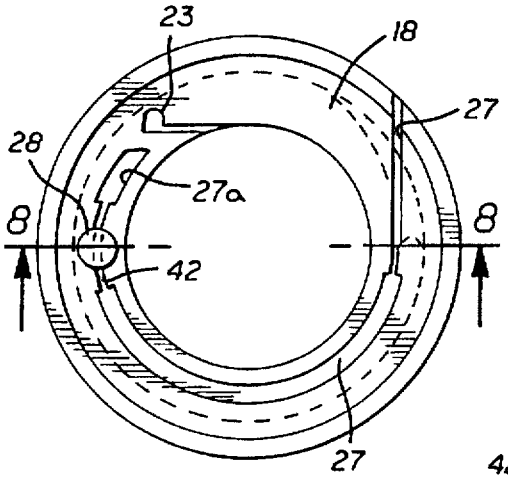
FIG. 7
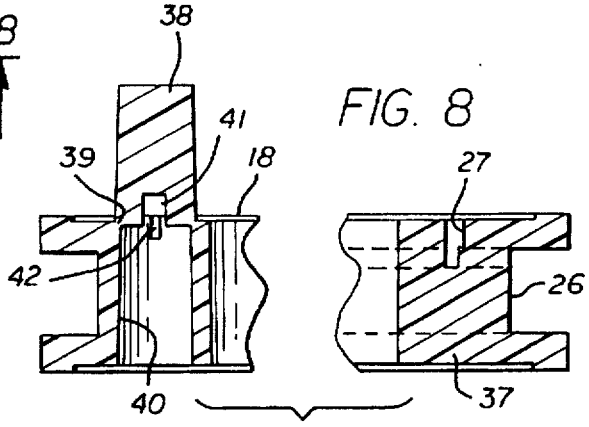
FIG. 8
FIG. 9
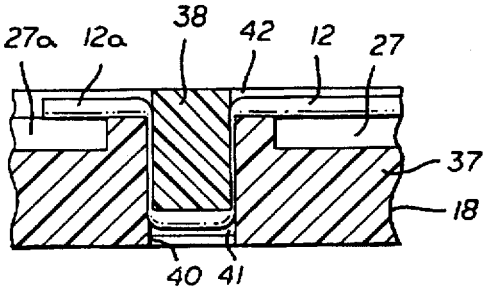

EXTENSION MEMBER ANCHOR

BACKGROUND OF THE INVENTION

This invention relates to a spring drive retractor and in particular to a new and improved reel construction for such a retractor.

Spring drive retractors have been in use for many years for use with a key for a lock. A typical retractor has a reel with a line or other form of extension member and a spiral spring mounted in a case, with the extension member wound on the wheel and having an external end for attachment to a key or the like. Typically, retractor cases are mounted on a belt or other article with a clip, a safety pin, a hook and eye fastener or otherwise as desired. Spring drive retractors were initially designed for use with a ring of keys, but more recently very small size retractors have been provided for use with a single key. Also, other articles such as Identification cards, magnetic access cards and the like are being used with spring drive retractors.

The extension member is a flexible member typically a cord or a cable or a monofilament which must be anchored at one end to the reel inside the retractor case and at the other end to a ring or other fitting. This typically has been achieved by a knot or a ball swaged in place or a fitting crimped in place or a noose type connection. These previous types of connections require additional components for the retractor and/or additional labor to make the connections.

SUMMARY OF THE INVENTION

Accordingly, it is an object of the present invention to provide a new and improved reel with means for an easy, quick and secure connection between the reel and the extension member. It is a particular object of the invention to provide such a reel in the form of a single molded piece which requires only threading of one end of the extension member through an opening and compressing the reel to affix the extension member to the reel.

In the presently preferred embodiment of the spring drive retractor of the invention, a case has an inner space for a spring and a reel, with one end of the spring connected to the case and the other end of the spring connected to the reel, and with an extension member having one end connected to the reel and the other end passing outward through the case. The improved reel has a body and a post molded as a single piece with the post projecting laterally from the body in line with a transverse opening in the body and with the post and body joined by a rupturable membrane. The post has an extension member receiving opening whereby an extension member may be connected to the reel by driving the post into the body opening.

The invention also includes a method of anchoring a line to an anchor member, including the steps of molding an anchor member as a single piece having a body and a post with the post projecting from the body in line with an opening in the body and with the post and body joined by a rupturable membrane, positioning a line in an opening in the post, and pushing the post into the opening in the body rupturing the membrane and fastening the line between the post and the body.

The invention also includes an anchoring system for joining a line to an anchor member comprising a body and a post molded as a single piece with the post projecting from the body in line with an opening in the body and with the post and body joined by a rupturable membrane, the post having a line opening whereby the line may be connected to the anchoring member by driving the post into the opening of the body.

Other objects, advantages, features and results will more fully appear in the course of the following description.

BRIEF DESCRIPTION OF THE DRAWINGS

FIG. 5 is a view similar to that of FIG. 2 showing the interior of the back of the case;

FIG. 6 is an enlarged partial sectional view taken along the line 6—6 of FIG. 5;

FIG. 7 is a side view of the reel of the retractor of FIG. 1 prior to attachment of the extension member;

FIG. 8 is an enlarged sectional view taken along the line 8—8 of FIG. 7; and FIG. 9 is an enlarged partial sectional view taken along the line 9—9 of FIG. 2.

DESCRIPTION OF THE PREFERRED EMBODIMENT

Figure 1:
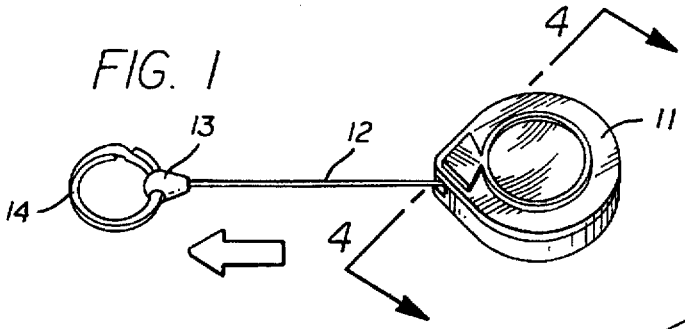
FIG. 1 is a perspective view illustrating a spring drive retractor incorporating the presently preferred embodiment of the invention.

The retractor as shown in FIG. 1 includes a case 11, an extension member 12 with an outer end fitting 13, and a ring 14 carried in the fitting. This construction is conventional, and various forms for the extension member, fitting and ring may be utilized.

The case is formed of a front 15 and a back 16 which are designed to snap fit together and may be fixed in place by an adhesive or otherwise as desired. A spring 17 and a reel 18 are mounted in the back, with the spring positioned inside the reel. The inner end 19 of the spring is positioned between bosses 20, 21 formed in the back, with a turned up spring end retaining the spring in place. The outer end 22 of the spring also has a turned up end which fits into an opening 23 in the reel for fixing the outer end of the spring to the reel. The reel has a peripheral groove 26 with the extension member wound thereon, and another groove 27 in one side face of the reel for feeding the inner end of the extension member from the bottom of the groove 26 to an extension member anchoring position 28. The construction and operation of the spring and reel are conventional, except for the anchoring position, which will be described in detail hereinbelow.

If desired, an opening 31 and a notch 32 may be provided in the back 16 for receiving a spring clip 34 for attaching the retractor to a belt or other object.

The reel 18 has a body 37 and a post 38, best seen in FIG. 8. The body and post are molded as a single piece, typically of a plastic such as Delrin, with a rupturable membrane 39 joining the post and body. An opening 40 is formed in the body 37 positioned transversely in the body, that is, parallel to the axis of rotation of the reel. Another opening 41 is provided in the post 38, typically a slot at the inner end of the post. The opening 40 in the body is dimensioned to be a push fit for the post 38. An additional groove 27*a* is provided in the reel beyond the position 28 for the free inner end 12*a* of the extension member 12. A groove 42 is provided in the reel for the extension member 12 at the anchoring position 28 between the grooves 27 and 27*a*.

Figure 2:
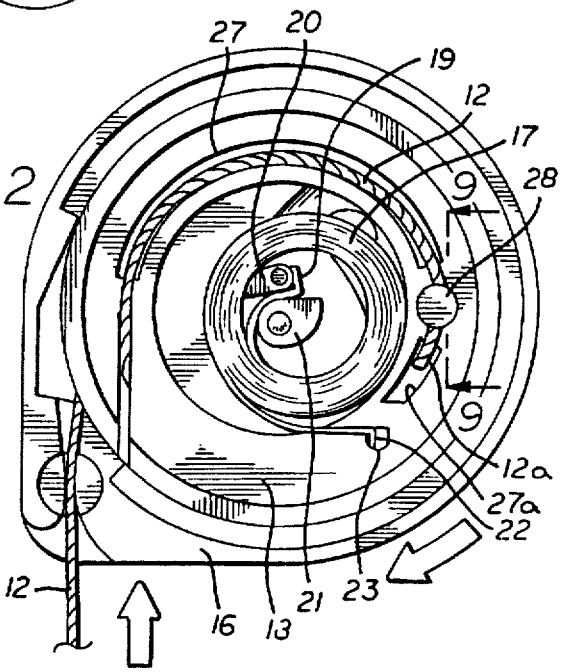
FIG. 2 is an enlarged view of the case of the retractor of FIG. 1, with the front removed.
Figure 3:
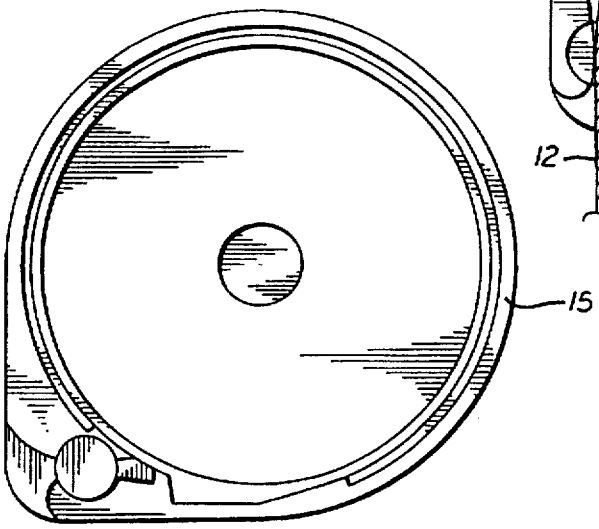
FIG. 3 is a view of the interior of the front of the retractor of FIG. 1.
Figure 4:
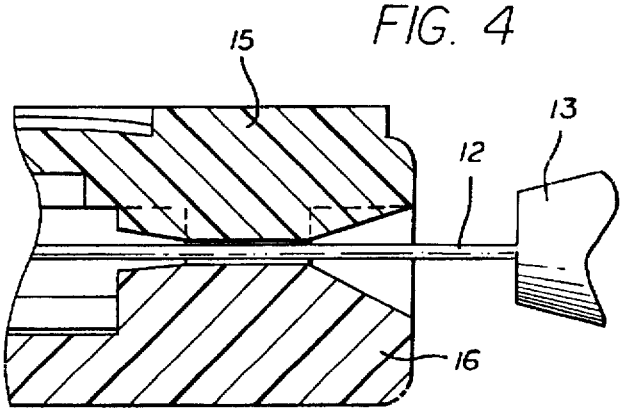
FIG. 4 is an enlarged partial sectional view taken along the line 4—4 of FIG. 1.

In use, the inner end of the extension member is positioned in the groove 27 of the reel and pushed into, preferably through, the opening 41 of the post, and then the post 38 is pressed or driven into the opening 40, with the driving pressure rupturing the membrane 39. When the post is pressed into the body opening, the inner end of the extension member is fixed in place on the reel. Typically, two or three inches of the extension member is pushed through the opening 40, for ease of handling. Most of this material is cut-off after the post is pushed into the body, leaving the connection in the condition show in FIG. 9. The main portion of the extension member is wound on the reel, the reel is placed in the back as shown in FIG. 2, and the spring is placed in the back engaging the back and the reel. Finally, the front is placed onto the back, completing the assembly of the retractor.

Thus the assembly of the retractor is accomplished without requiring any additional components or knotting or looping of the extension member.

The anchorage achieved with the present invention is simple and strong. The preferred embodiment uses a three strand spiral wound nylon cord approximately 0.018 inches diameter with a catalog breaking strength of 20 pounds. The anchorage will attain a breaking strength of approximately 15 pounds which is significantly higher than knots or swaged fittings which break at approximately ten pounds. Also the design uses a minimum of space and can be produced away from the extension member groove in the reel. This feature eliminates bulges, humps, interruptions and two piece assembly resulting in a smooth track for the cord to wind on.

We claim:

1. In a spring drive retractor having a case with an inner space for a spring and a reel, with one end of the spring connected to the case and the other end of the spring connected to the reel, and with an extension member having one end connected to the reel and the other end passing outwardly through the case, a reel having an axis of rotation and comprising a body and a post molded as a single piece with said post projecting from said body parallel to said reel axis of rotation and in line with a transverse first opening in said body and with said post and body joined by a rupturable membrane, with said post in a first position outside said body, said post having an axis in line with said first opening, and said post having means defining an extension member receiving second opening, said first opening being dimensioned to be a push fit for said post, with said post movable along said post axis into said body first opening from said first position into a second position inside said body rupturing said membrane and positioning said post with said second opening in said body first opening fixing the extension member in said reel.

2. A reel as defined in claim 1 with said post in said body transverse first opening with said extension member affixed in said post second opening.

3. A reel for a spring drive retractor and having an axis of rotation, said reel comprising a body and a post molded as a single piece with said post projecting from said body parallel to said reel axis of rotation and in line with a transverse first opening in said body and with said post and said body joined by a rupturable membrane, said post having an axis in line with said first opening, with said post in a first position outside said body, said post having a transverse second opening, said post moving along said post axis into said body transverse first opening from said first position into a second position inside said body when said membrane is ruptured by said post movement and moving said second opening into said first opening, said first opening being dimensioned to be a push fit for said post.

* * * * *